United States Patent [19]

Newman et al.

[11] Patent Number: 4,922,806

[45] Date of Patent: May 8, 1990

[54] DOORS FOR NEGATIVE AIR PRESSURE ENCLOSURE

[75] Inventors: Eugene E. Newman, Maple Shade; Anthony Natale, Mt. Holly, both of N.J.

[73] Assignee: GPAC, Inc., Pennsauken, N.J.

[21] Appl. No.: 346,621

[22] Filed: May 2, 1989

[51] Int. Cl.[5] ..... E06B 7/02

[52] U.S. Cl. ..... 98/1.5; 98/98; 98/119

[58] Field of Search ..... 55/385.2; 98/1.5, 33.1, 98/42.09, 42.1, 42.12, 42.16, 42.19, 87, 116, 119

[56] References Cited

U.S. PATENT DOCUMENTS

| | | | |
|---|---|---|---|
| H460 | 4/1988 | Werner | 55/385.2 |
| 587,823 | 8/1897 | Holbrook et al. | |
| 1,547,974 | 7/1925 | Thaw | 98/119 |
| 2,554,822 | 5/1951 | Geier | 98/87 X |
| 2,871,523 | 2/1959 | Negoro | 98/87 X |
| 3,064,963 | 11/1962 | Wilson | |
| 3,211,075 | 10/1965 | Robson | 98/1.5 |
| 3,284,840 | 11/1966 | Ulman | |
| 3,391,628 | 7/1968 | Ziegenfelder | 98/87 X |
| 3,394,427 | 7/1968 | Vietz | |
| 3,477,176 | 11/1969 | Tansley | |
| 3,807,480 | 4/1974 | Smart | 160/1 |
| 3,876,385 | 4/1975 | Markus et al. | 23/490 |
| 3,916,566 | 11/1975 | Lacombe | 49/7 |
| 3,964,125 | 6/1976 | Tansley | 16/48.5 |
| 4,150,606 | 4/1979 | Nelson | 98/115 LH |
| 4,287,638 | 9/1981 | McCabe | 17/48.5 |
| 4,506,407 | 3/1985 | Downey | 16/48.5 |
| 4,604,111 | 8/1986 | Natale | 55/97 |
| 4,706,413 | 11/1987 | James | 49/477 |
| 4,706,551 | 11/1987 | Schofield | 98/33.1 X |
| 4,750,922 | 6/1988 | Griffis | 55/210 |
| 4,973,173 | 8/1976 | Smith | 317/142 TD |

FOREIGN PATENT DOCUMENTS

| | | | |
|---|---|---|---|
| 1087926 | 8/1960 | Fed. Rep. of Germany | 98/87 |

*Primary Examiner*—Harold Joyce

*Attorney, Agent, or Firm*—Fleit, Jacobson, Cohn, Price, Holman & Stern

[57] ABSTRACT

An entranceway to an asbestos contaminated work area includes solid doors for a rapid escape from a contaminated work area due to an emergency such as a fire and the danger posed by exposure to smoke. Also during a power failure it is easy for the workers to leave the work area. The immediate exiting from the work area is thereby greatly facilitated by the solid swinging doors. Each of the doors have a transparent portion through which the work area or an adjacent chamber of a decontamination chamber may be observed. The doors further include an air inlet having at least one flexible plastic flap covering the inlet which allows suitable amounts of air to flow through the inlet to maintain a negative air pressure in the work area while the air in the work area is changed at least every 10 to 15 minutes. The plastic flaps of the doorway seal automatically upon loss of negative air pressure in the work area.

9 Claims, 3 Drawing Sheets

DOORS FOR NEGATIVE AIR PRESSURE ENCLOSURE

FIELD OF THE INVENTION

This invention relates to doors for a negative air pressure enclosure which prevent the escape of asbestos-containing air from the enclosure to the outside environment, automatically, upon the loss of negative air pressure in the enclosure and allows rapid escape of personnel from the enclosure.

BACKGROUND OF THE INVENTION

In U.S. Pat. No. 4,604,111, a particulate contamination control method and filtration device is disclosed. This patent relates to the serious dangers associated with persons breathing particulate contaminated air. The invention is useful for protecting the outside environment and the individuals working in a highly contaminated area such as occurs when asbestos coatings are removed inside a building structure.

Asbestos fibers fall into the generic classification of hazardous particulate and are a well known carcinogenic hazard to humans and animals. Typical environmental standards refer to fibers that are 5 microns or greater in length with an aspect ratio of 3 to 1 or greater. The average asbestos fiber is about 0.1 micron in diameter. It is now accepted that the thinner fibers are the most dangerous threat to human health. The asbestos fibers, in particular those that are thinner and shorter, remain airborne for considerable lengths of time and contaminate large volumes of air to form a substantial hazard to the environment and to the persons working or living in the area.

U.S. Pat. No. 4,604,111 provides a system and method of containing, lowering, and essentially eliminating the danger of asbestos inhalation by workers in a building in which asbestos fibers are generated at extremely high levels. Asbestos fibers are prevented from being released into the outside environment during an unforseen accident such as a leak through a damaged film barrier and by a flap seal which seals an inlet to a contaminated work area through which workers pass to gain entrance to and exit from the work area.

The flap seal is formed in a plastic wall defining the work area. The "flap seal" includes a two foot by five foot opening about a foot off the floor in a sheet of plastic film, such as polyethylene, plasticized polyvinyl chloride or the like, sealed across an existing door frame of the work area. A polyethylene sheet is sealed across a door frame with an opening cut through the film. The flap is larger in all dimensions than the opening of the same film, is attached to the door frame above the opening and hangs over the full length of the opening such that air and the workers may pass into the work area through the opening, pushing flap inwardly. However, the configuration is such that once the air flow ceases and positive air pressure develops in the enclosure, the flap falls into place and air is prevented from escaping in the opposite direction to the environment outside of the work room.

In the 4,604,111 patent, the flap seal is designed to seal the inlet into the contaminated work area. This arrangement has proved very effective in preventing escape of asbestos fibers in the event of loss of negative pressure. However, other factors need to be considered in designing a combined entranceway and exit from a contaminated work area.

SUMMARY OF THE INVENTION

By the present invention, an improved entranceway to an asbestos contaminated work area is provided. The solid door of the invention allows a rapid escape from a contaminated work area due to an emergency such as a fire and the dangers posed by exposure to smoke. Also during a power failure it is easy for the workers to leave the work area. The immediate exiting from the work area is thereby greatly facilitated by the solid swinging doors of the invention.

The solid swinging doors of the invention each may have a transparent portion through which the work area or an adjacent chamber of a decontamination chamber may be observed. The doors further include an air inlet having at least one flexible plastic flap covering the inlet which allows suitable amounts of air to flow through the inlet to maintain a negative air pressure in the work area while the air in the work area is changed at least every 10 to 15 minutes. The plastic flaps of the doorway seal automatically upon loss of negative air pressure in the work area.

An object of the present invention is to provide solid swinging doors for the inlet of air into an enclosed work area to maintain a negative air pressure in the work area while allowing a quick exit from the work area in the event of an emergency.

It is another object of the present invention to allow air to pass through a door having an air inlet opening with a flap seal on one side of the doorway so that the air inlet opening is closed upon the loss of negative air pressure in the enclosed work area.

It is still another object of the present invention to provide doors to an enclosed work area which are controlled to swing to a partially open position to allow inlet of air to an enclosed work area to maintain a negative air pressure in the work area and for the doors to close upon the loss of negative air pressure in the work area while allowing a quick exit from the work area in the event of an emergency.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
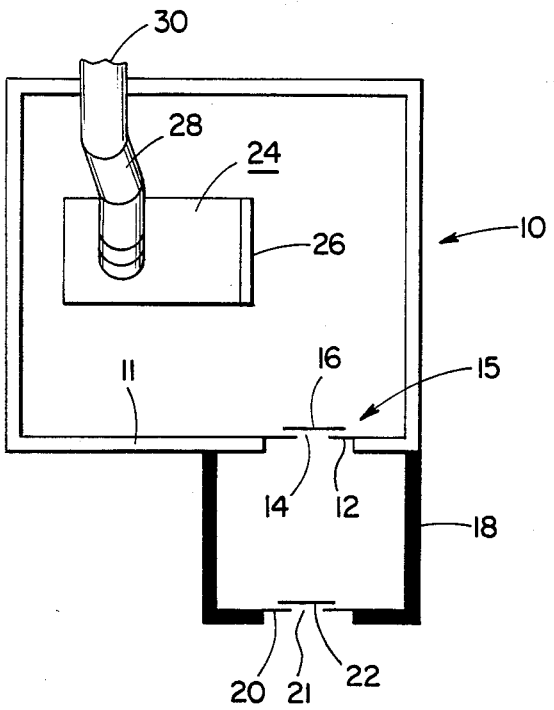
FIG. 1 (PRIOR ART)
FIG. 1 is a floor plan illustrating the use of a prior art entranceway for a particulate contamination control enclosure.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

FIG. 1 illustrates the prior practice wherein on the job site, enclosure 10 surrounds an area of high particulate accumulation. This illustrates the embodiment wherein a sealed room is constructed around the area of contamination in its most simple configuration. For the purposes of this figure and of the other floor plan of FIG. 2, the floor and ceiling are in all cases present to complete the enclosure. However, it should be understood that air intakes or inlets, control for air flow, exit ports or outlets and even doorways can be constructed to enter through the roof or through the floor in the same fashion as they are illustrated as passing through the walls in FIGS. 1 and 2. Whenever the term "wall" is used, it is intended to include any of the four vertical walls as well as the ceiling or the floor.

Decontamination chamber 18 is constructed to allow entrance to and exit from enclosure 10 through doorway 15 into the chamber, closed from the outside with flap 22 over opening 21 in film barrier 20. Filtration system 24 is placed in the contamination area in enclosure 10 such that air entering port 26 is filtered and expelled to the environment with 99.99 percent of the particulate contaminants of 0.3 micron size removed through air communication duct 28 to exit vent 30. The filtration system 24 in FIG. 1 is illustrated larger than scale and is preferably placed in a part of the enclosure near the contamination source such that the particulate, such as asbestos coatings, may be removed while maintaining the particulate concentration in the work area at a satisfactory level. This is particularly effective when the source of contamination, typically the work area, is between the persons and the filtration system 24. The substantial air flow being pulled into the filtration means provides a continuous vacuum in enclosure 10 drawing air through the flap seals and maintaining a negative pressure in the room at all times.

Figure 2:
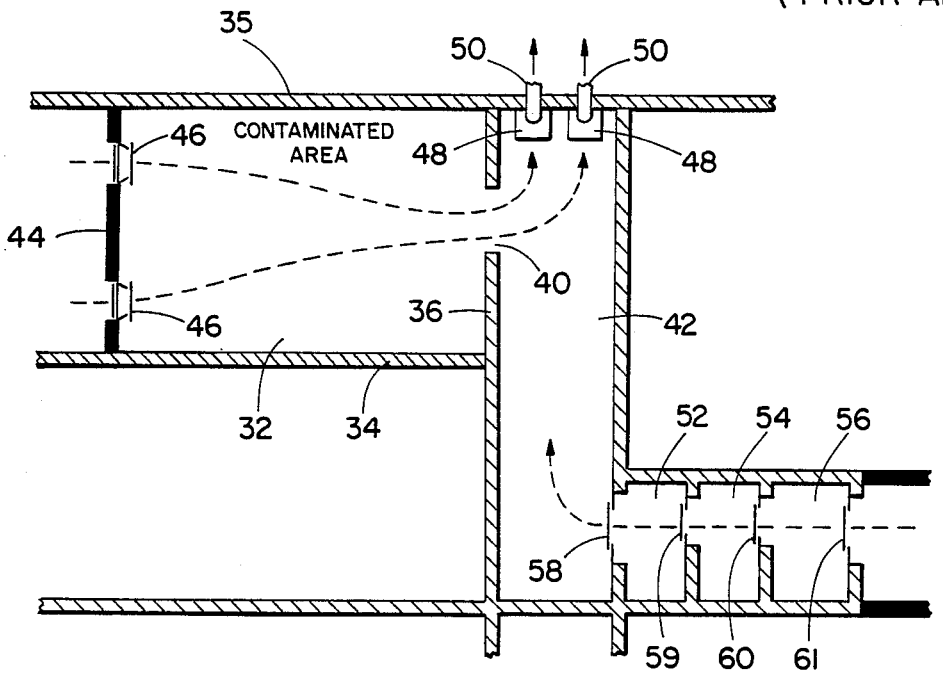
FIG. 2 (PRIOR ART)
FIG. 2 is an additional floor plan illustrating the erection of a decontamination chamber using a prior art entranceway for a particulate contamination control enclosure.

In FIG. 2, a somewhat more complicated configuration is illustrated. In this situation, the contaminated area is in room 32 for which there are three permanent walls 34, 35 and 36 with doorway 40 opening in wall 36 from room 32 to hallway 42. Doorway 40 is maintained in an open condition and any doors are removed or fixed in an open position.

The position of the walls and wall 36 form a barrier to cause the air to flow past the work area and away from the workers who should start at wall 44. Wall 44 is a temporary film wall from floor to ceiling with two flap seals 46 providing for controlled air flow into room 32, past the contaminated area through doorway 40 and into hallway 42 to a pair of filter systems 48, expelling air through exit ports 50 with the general air flow shown by the dotted lines and arrows. Located on the opposite end of hallway 42 is a decontamination system, including a series of three chambers, dressing room 52, shower room 54 and dressing room 56, containing various decontamination equipment and safety devices including showers, clothing discard systems and vacuum removal, with each successive decontamination chamber being cleaner and cleaner toward the outside environment as each is equipped and separated from the other with flap seals 58 through 61. These flap seals are large enough that a person can enter and leave through the opening by pushing the flap aside. The doorway between hallway 42 and decontamination chamber 52 is equipped with a flap seal 58 as is chamber 56 with flap seal 61, to the outside environment.

Air flow is allowed through the flap seals, through the decontamination chambers, into hallway 42, to be pulled to filter systems 48 to be expelled into the atmosphere after particulate contamination has been removed. In this configuration, in essentially all areas of the decontaminated area, the particulate is being drawn away from the work place, out of the room and away from persons working in room 32.

Figure 3:
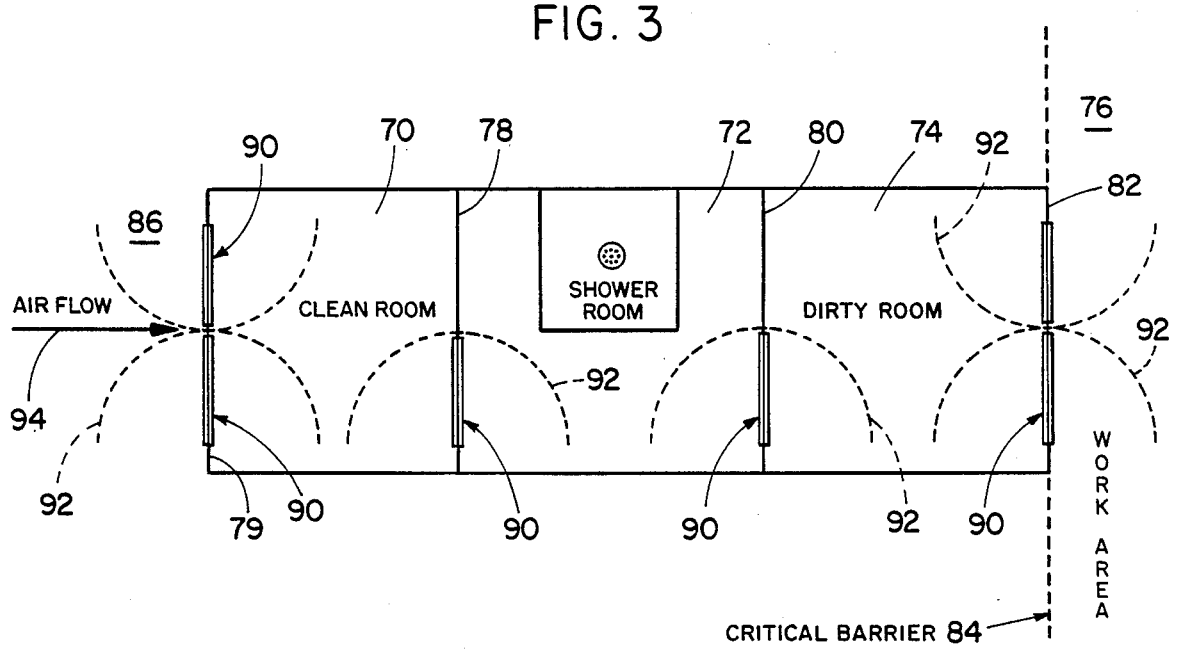
FIG. 3 is a plan view of a decontamination chamber having the solid swinging doors of the present invention.

In FIG. 3, a decontamination chamber similar to that of FIG. 2 is shown in that clean room 70 is separated from shower room 72 and dirty room 74 which leads into work area 76. An enclosed work area as explained with reference to FIGS. 1 and 2 is intended to be shown by work area 76. Solid wall 78 separates clean room 70 and shower room 72 whereas solid wall 80 separates the shower room 72 from dirty room 74. Wall 82 separates the dirty room 74 from work area 76. A critical barrier 84 extends beyond the edges of wall 82 to define the limits of work area 76. The critical barrier may be a solid wall or temporary film wall construction. Walls 78, 80, and 82 may be a pre-existing wall, a wall built for the decontamination chamber or be of temporary film wall construction.

To gain access from the clean area 86 to the clean room 70, from the clean room 70 to the shower room 72, from the shower room 72 to the dirty room 74, and from the dirty room 74 to the work area 76, there exists a series of single or double negative air pressure doors 90. A path of movement of an inner edge of each of the doors 90 is shown by dotted lines 92. An opposite outer edge of the door is pivotably mounted in a respective wall or door frame for free swinging movement of the doors 90 through 180° of movement.

Figure 4:
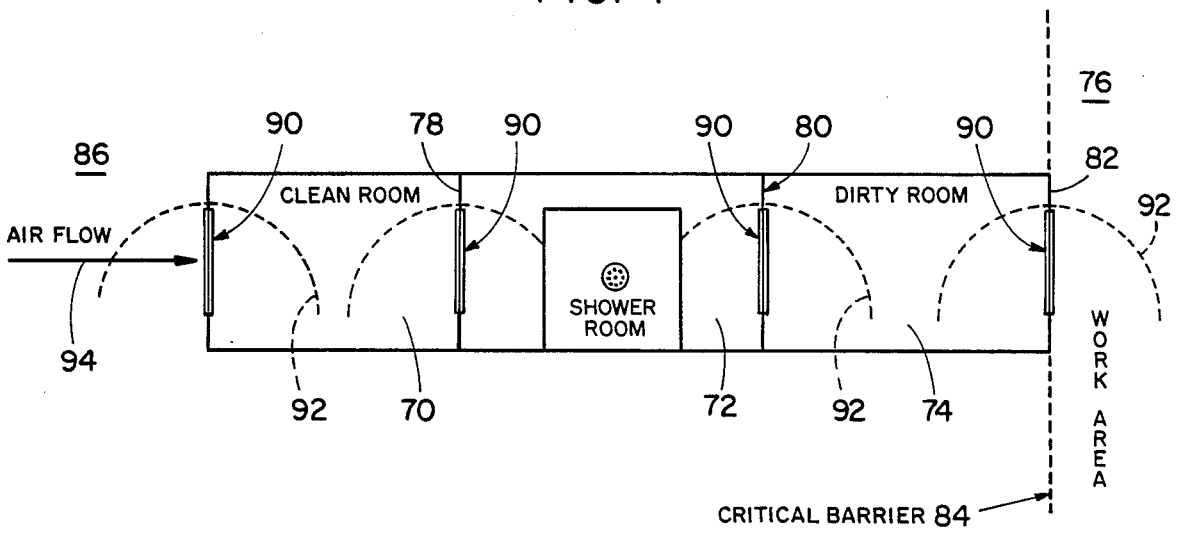
FIG. 4 is a plan view of another decontamination chamber having the solid swinging doors of the invention.

Air flow, as represented by arrow 94, is from the clean area 86 into the clean room 70, into the shower room 72, into the dirty room 74 and into the work area 76. A difference between FIGS. 3 and 4 is that in FIG. 4 all single doors 90 are used whereas in FIG. 3, double doors 90 are mounted in walls 79 and 82. The purpose of the doors and their special functioning is best explained with reference to FIGS. 5 through 8.

Figure 5:
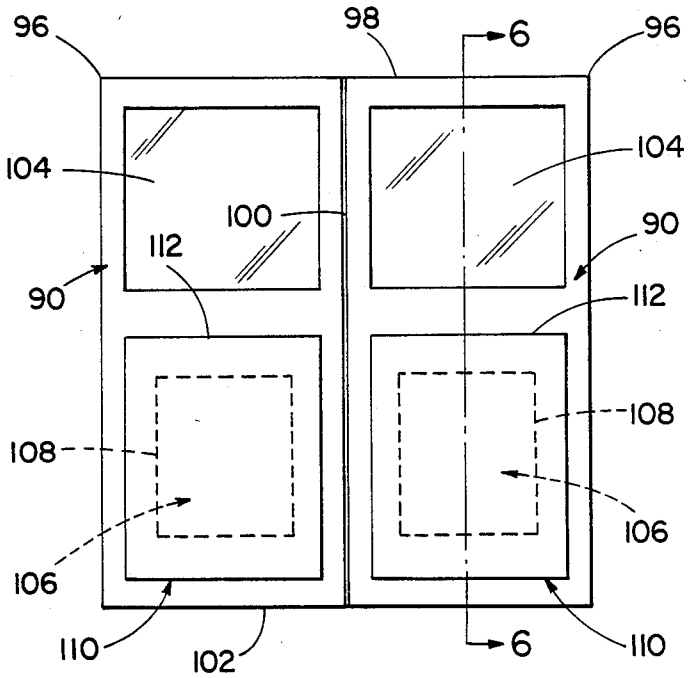
FIG. 5 is a side elevational view of a set of double doors according to the present invention.
Figure 7:
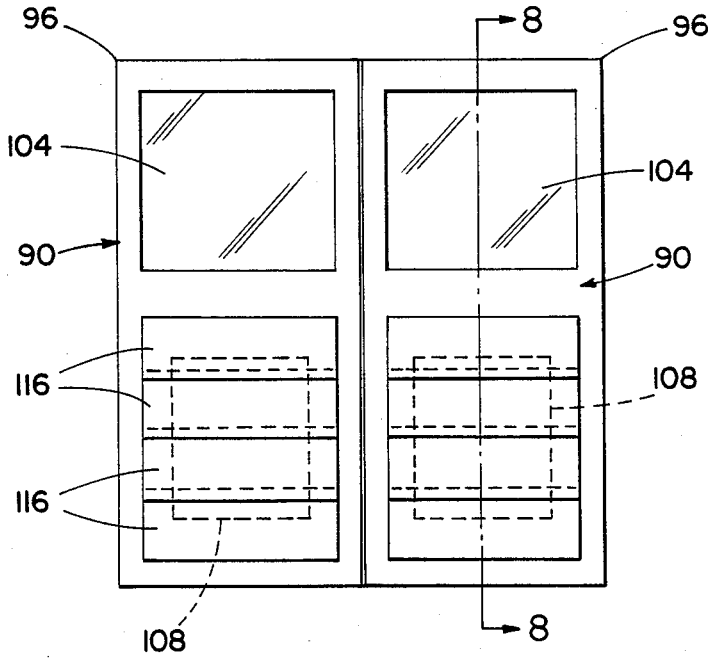
FIG. 7 is a side elevational view of a set of double doors according to an alternative embodiment of the invention.

As shown in FIGS. 5 and 7, double doors 90 are shown as illustrated in FIG. 3 for the entrance to the clean room and for the entrance from the dirty room to the work area. Doors 90 are solid swinging doors capable of 180° movement about pivots or hinges located at the anchored outer edges 96 of the doors and mounted in door frames or walls. At edges 96, and at top edge 98, inner edge 100 and bottom edge 102 are air-sealing gaskets formed of rubber strips which seal the space between the doors and the frames within which the doors are mounted when the doors are in a closed position. The gaskets prevent the movement of air around the doors.

In the closed position, viewing into an adjacent chamber of the decontamination chamber or into the work area or surrounding clean area 86, is facilitated through windows 104 which are preferably made of clear plastic, one-quarter inch thick. In FIGS. 5 and 7, the windows 104 are located in the top portion of the doors; however, it is not necessary that the windows be so located. In the bottom portion of the doors 90 in FIGS. 5 and 7, is defined an air inlet 106 which is formed by peripheral edges 108 shown in dotted lines and in full lines in FIGS. 6 and 8.

In FIG. 5, a flexible plastic flap 110 is mounted at a top edge 112 on a side of the door 90 facing towards the work area 76. By the use of an air moving and filtering device within the work area there is a constant air flow towards the work area as shown by arrow 114 in FIG. 6. The air movement causes the flexible plastic flap 110 to move towards the work area and allow air flow through the air inlet 106. Upon termination of power to the air moving and filtering device, or upon loss of negative air pressure for any reason, the flexible plastic flap will return to a position paralleling the surface of the door 90 so as to seal the air inlet 106 against egress of air from the work area towards the clean area 86. A positive air pressure builds up within the work area 76 and forces the flap 110 against the door and seals the flow of asbestos fiber contaminated air out of the work area.

Figure 6:
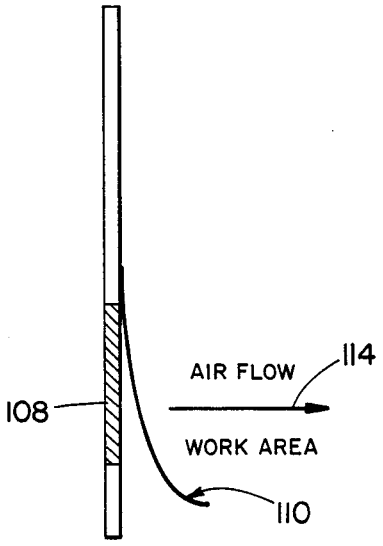
FIG. 6 is a sectional view taken along line 6—6 of FIG. 5.
Figure 8:
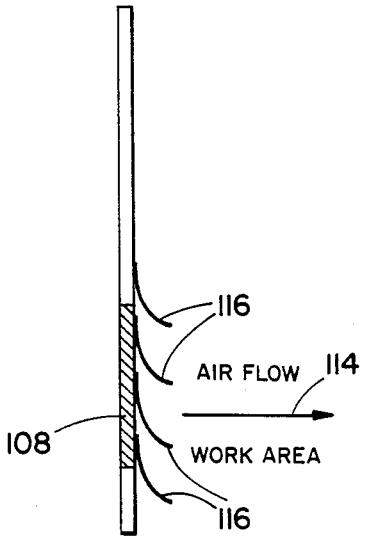
FIG. 8 is a sectional view taken along lines 8—8 of FIG. 7.

Similarly, in FIGS. 7 and 8, a series of partially overlapping flexible plastic flap louvers 116 made of plastic strips are mounted along their top edge to the interior surface of the door, as best shown in FIG. 8 to form a series of flap seals similar to the flap seal formed by flexible plastic flap 110 in FIGS. 5 and 6. The same result is achieved by the flap louvers in FIG. 7 as is accomplished by the single flexible plastic flap 110 in FIG. 5. It is appreciated that the flaps 110 and 116 can be located at the top, the bottom or middle of the door and be of any size to suit the cubic foot per minute requirements for air movement through an air inlet. In addition, the doors 90 are self-closing by a spring, gravity, weights, eccentric cam, etc. for constant return of the doors to a sealing position with their inner edges adjacent each other to allow passage of air from a clean area to a work area through the air inlets, viewing of an adjacent area or room through windows 104 and access for the workers to enter or leave the work area through the doors 90.

During an emergency situation in the work area, the workers may quickly escape from the work area by merely pushing on any portion of the door 90. The doors will rapidly swing open in a direction away from the work area to provide an unhindered path of egress. This design proves much more effective than attempting to pass through a design of overlapping plastic sheets which must be carefully maneuvered to allow passage of personnel.

As an alternative embodiment, the doors 90 may be electro-mechanically operated and controlled to open (and close) to varying degrees. The door operation responds to a signal to open or close the doors to a slight degree as required to maintain a predetermined negative air pressure setting for the work area. The amount of opening of the doors is dependent upon the amount of air needed to flow into the work area in addition to or in place of the air inlets 108. The doors may automatically close upon receipt of a smoke/fire signal, an emergency signal, a power failure signal, etc. to prevent escape of contaminated asbestos while allowing the workers to leave the work area quickly.

Similarly, a solid door without an air inlet may be opened by a controlled amount to regulate the amount of air being drawn into the enclosed work area. The door itself, like the embodiment of the door with flaps over an air inlet, will be closed upon loss of negative air pressure. In addition, the door will close upon receipt of a smoke/fire signal, emergency signal, loss of power signal or any other contingency which might endanger workers in an enclosed work area due to the high air movement requirements of an asbestos particle contamination control system. The doors are pivotably mounted in a frame so that the personnel trapped within the enclosed work area may make a quick exit in an emergency and the doors will return to their closed position to prevent further escape of asbestos contaminated air.

Having described the invention, many modifications thereto will become apparent to those skilled in the art to which it pertains without deviation from the spirit of the invention as defined by the scope of the appended claims.

We claim:

1. A system for gaining access to and allowing air to flow into a sealed work area which is under negative air pressure and from which asbestos-containing material is removed, said system comprising:

access means for gaining access into the work area, wall means for isolating the sealed work area, said wall means defining at least one opening, said access means including a rigid door pivotably mounted in said at least one opening along a side edge for entrance and exit of personnel to and from the sealed work area, and said door including means for providing an air flow path into the work area under negative pressure and for sealing said air flow path automatically upon loss of negative air pressure.

2. A system according to claim 1, wherein said means for providing an air flow path includes a flap seal located on said door on a side of said door facing the sealed work area to seal said air flow path upon loss of negative air pressure in the work area.

3. A system according to claim 2, wherein said door is pivotable to move in opposite directions of movement from a position of rest.

4. A system according to claim 1, wherein said door includes a transparent portion for viewing through said door.

5. A door for entry to and exit from an asbestos containing work area, in which asbestos is to be removed under negative air pressure conditions, said door comprising:

a rigid frame pivotably mounted in a doorway and having an air inlet for passage of air therethrough, and sealing means mounted on said frame for automatically sealing said inlet upon loss of negative air pressure in said work area.

6. A door in accordance with claim 5, wherein said sealing means is located on one side of said frame closest to said work area.

7. A door in accordance with claim 6, wherein said sealing means includes at least one plastic flap mounted at one edge to said one side of said frame.

8. A door in accordance with claim 6, wherein said sealing means includes a plurality of overlapping plastic flaps mounted at one edge to said one side of said frame.

9. A system for maintaining a favorable environment for removing dangerous solid materials, said system comprising:

wall means enclosing a defined air space within a building, said wall means including at least one doorway, and rigid door means pivotably mounted in said at least one doorway for permitting entrance and rapid exit of personnel from the defined air space, a portion of said rigid door means providing an air flow path into the defined air space under negative air pressure and having means for sealing said air flow path automatically upon loss of negative air pressure in the defined air space.

* * * * *